United States Patent [19]

Etherington

[11] 4,285,546

[45] Aug. 25, 1981

[54] TUNNEL PROFILE CONTROL

[75] Inventor: Michael Etherington, Retford, England

[73] Assignee: Dosco Overseas Engineering Ltd., Newark, England

[21] Appl. No.: 110,541

[22] Filed: Jan. 8, 1980

[30] Foreign Application Priority Data

Jan. 17, 1979 [GB] United Kingdom ..... 01667/79

[51] Int. Cl.[3] ..... E21C 35/04

[52] U.S. Cl. ..... 299/1; 91/37; 251/3

[58] Field of Search ..... 299/1; 91/37; 251/3

[56] References Cited

U.S. PATENT DOCUMENTS

| | | | |
|---|---|---|---|
| 3,000,362 | 9/1961 | McCurdy | 91/37 X |
| 3,148,594 | 9/1964 | McCoy | 91/37 X |
| 4,023,861 | 5/1977 | Schnell | 299/1 |

FOREIGN PATENT DOCUMENTS 1340772 12/1973 United Kingdom .

*Primary Examiner*—Ernest R. Purser

*Attorney, Agent, or Firm*—Charles E. Brown

[57] ABSTRACT

An apparatus and method for controlling the profile of an aperture cut by a cutting head capable of traversing movement in two directions at right angles to each other, e.g. the cutting head of a mining machine, wherein means is provided to control the movement of the cutting head in said two directions and including a template for an internal profile representing that part of the aperture to be cut, a sensing device engageable with the template profile, follower means associated with the cutting head to cause relative movement between the sensing device and template in a direction related to movement of the cutting tool, movement of the sensing device into engagement with the profile operating hydraulic sensing equipment which automatically overrides the means to control the movement of the cutting head, thereby preventing the cutting head from moving beyond the desired tunnel profile. The hydraulic sensing equipment preferably comprises a series of control valves associated with respective quadrants of the profile which are connected together in such a manner as to reverse the direction of movement of the cutting head as necessary.

9 Claims, 3 Drawing Figures

Figure 1A:
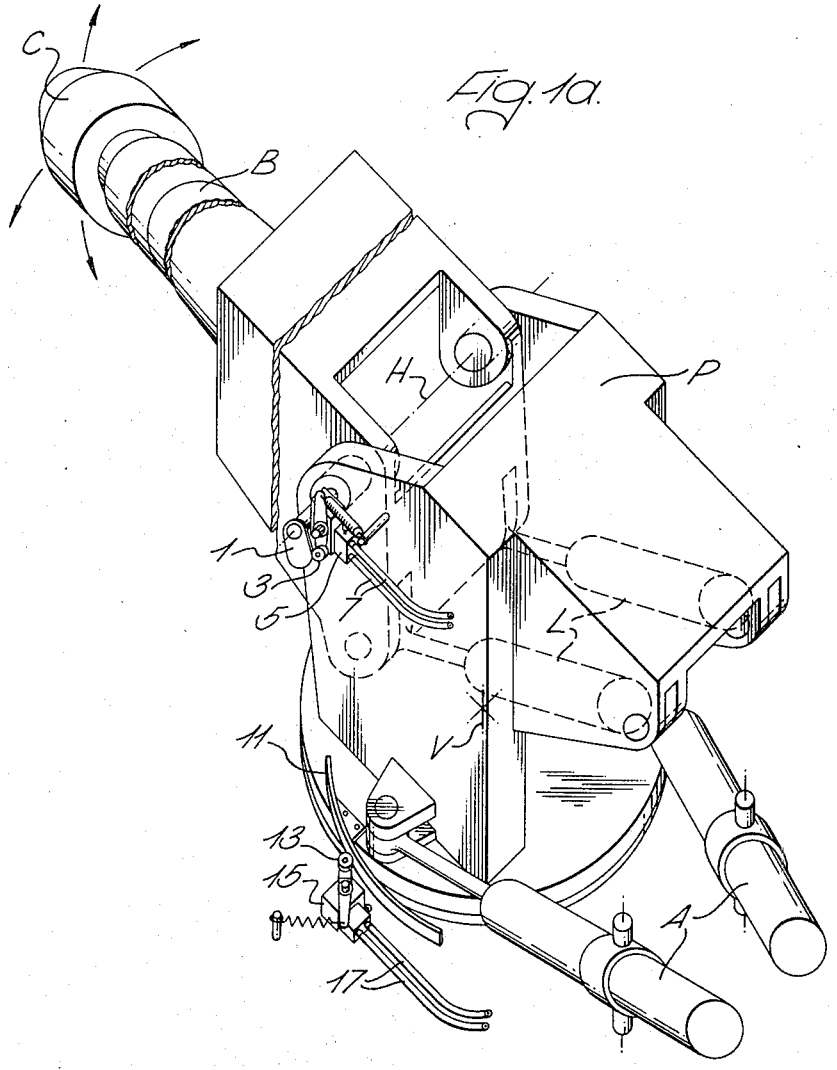

61
72
71
73
81
95
63
80
82
111
39
35
97
99
101
91
119
117
121
93
125
49
83
55
85
103
57
123
89
96
107
105
115
59
53
113
69
109
51
43
47
87
45
41

TUNNEL PROFILE CONTROL

This invention relates to an apparatus and method for controlling the profile of an aperture cut by a cutting head capable of tranversing movement in two directions and has been particularly designed for use in tunnel cutting machines where accurate tunnel profile is vital. However, the apparatus can also be used for other purposes, e.g. on free-steered track laying mining machines. If the profile is too small, the tunnel shield, when it is advanced, will jam. If this occurs it is an extremely expensive mistake to remedy. Alternatively, if the profile is too large, then excess grout has to be pumped around the segments which are used to line the tunnel. Again, this can be extremely expensive.

Various profile control systems are at present available but none of these is particularly reliable. One system is an electronic system and the location of the cutting head is projected onto a screen which is masked with the desired tunnel profile. The success of this apparatus depends upon the skill of the cutting head machine operator, as he must manipulate the cutting head to the confines of the profile mask but no further.

We have now developed a system which we hope can be used by any operator of average skill, which is designed to make it impossible for the operator to cut too large a profile and yet which is completely safe for use in coal mines because it can be totally fluid operated, e.g. hydraulically operated.

According to the present invention, we provide apparatus for controlling the profile of an aperture cut by a cutting head capable of traversing movement in two directions at right angles to each other, comprising means to control the movement of the cutting head in said two directions, a template having an internal profile representing that of the aperture to be cut, a sensing device engageable with the profile of the template, follower means, responsive to movement of the cutting head to cause relative movement between the sensing device and template in a direction which is related to the direction of movement of the cutting head, said sensing device coming into engagement with the profile of the template when the cutting head has been traversed sufficiently in a particular direction so as to reach its desired profile extremity, and hydraulic sensing equipment which is actuated in response to said sensing device and template coming into engagement, said sensing equipment being effective to over-ride said means controlling the movement of the cutting head to ensure the head does not cut outside its desired profile.

Preferably, the apparatus is part of a tunnel cutting machine, which is provided with hydraulic control means for moving a boom-mounted cutting head in vertical and horizontal planes, and with hydraulic sensors for sensing the horizontal and vertical movements of the cutting head, said sensors, through suitable hydraulic circuitry, translating said movement to the template, which is mounted on a table for movement related to that of the head.

Preferably, the sensing device is supported on a stub shaft projecting from an actuator plate which is mounted for universal rocking movement, as a result of engagement between the template and sensing device, in two horizontal planes at right angles to each other, and associated with the two planes of movement of the cutting head, there being one pair of sensors responsive, respectively, one to rocking movement of the plate in one sense and the other in the opposite sense, in one plane, and a second pair of sensors responsive, respectively, one to rocking movement of the plate in one sense and the other in the opposite sense, in the second plane, the arrangement being such that said plate rocks when said template moves into engagement with the sensing device when an attempt is made to move the cutting head beyond the boundary of said profile.

Preferably, the hydraulic control means for the cutting head includes a joystick unit comprising an operating lever and four hydraulic control valves, one associated with a respective quadrant of the profile to be cut, and suitable hydraulic circuitry supplying or venting hydraulic pressure to respective sides of arcing and lifting pilot operated main control valves which operate the respective lifing and arcing piston/cylinder devices of the boom, each of the sensors being associated with a hydraulic control valve means for over-riding the hydraulic control means, either to prevent lifting/lowering or arcing of the boom, or to reverse such movement, dependent on the position of the template relative to the sensing device.

Preferably, the hydraulic control valve means comprise two control valves, one operative when there is pressure in the circuitry as a result of the joystick operating lever being in an operative position, and the other which is supplied from a second pressure source when the joystick operating lever is in an inoperative position in which there is no such pressure.

Preferably, the above described hydraulic control arrangement comprises a pilot control system for the main lifting and arcing valve and cylinder device for controlling the boom or other device on which the cutting head is mounted.

So as to enable "dead spots" which are reached when the cutting head is at any 45° position to the horizontal and vertical axes of the tunnel, diverter valves are provided in the hydraulic control arrangement so that when the joystick operating lever is operated to move the cutting head out of the quadrant associated with the "dead spot," the pressure leading to both sides of both the arcing and lifting main control valves will be diverted to one side of the respective control valve and vented or dumped.

The invention also extends to a method of controlling the profile of an aperture cut by a cutting head, e.g. that of a tunnel cut by a mining machine.

Figure 1B:
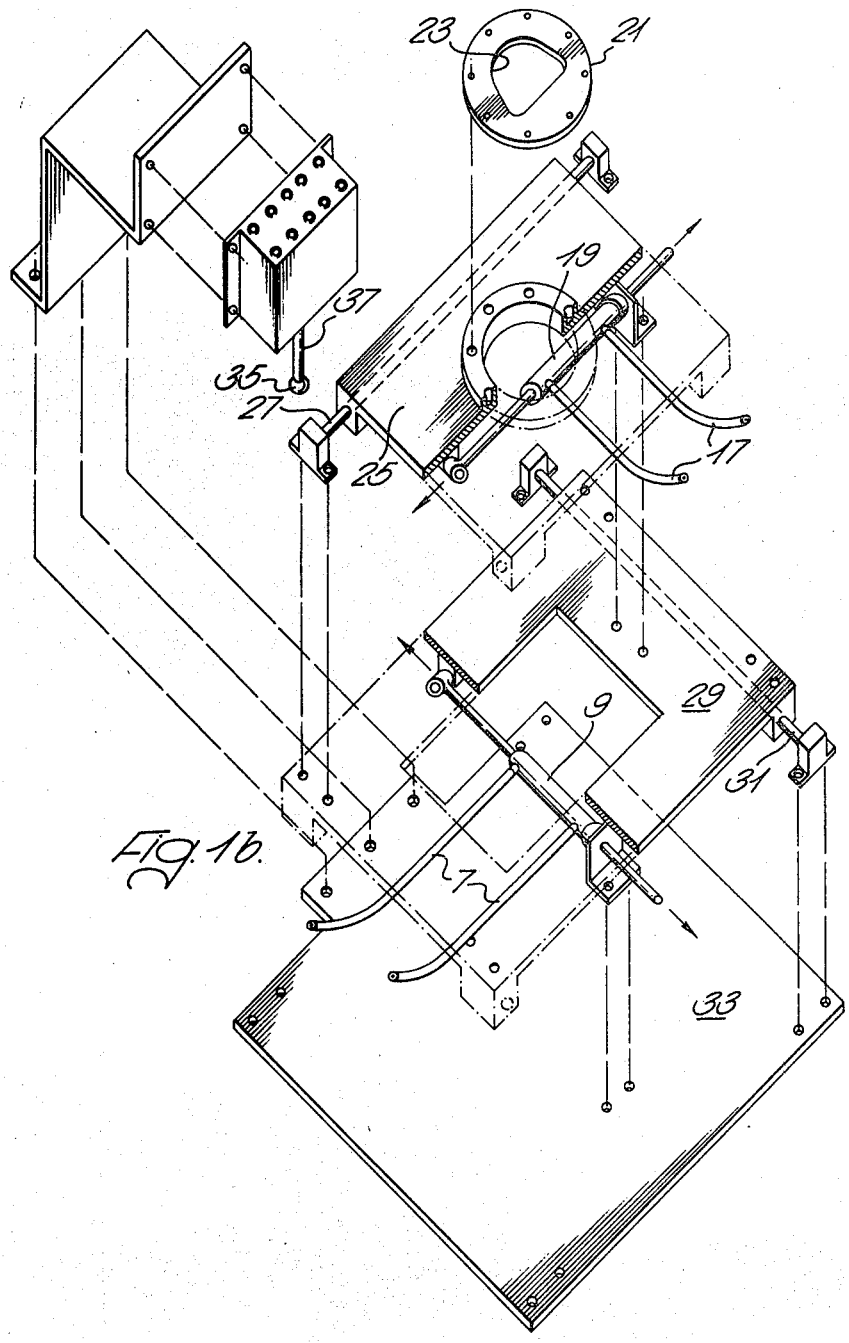
Figure 2:
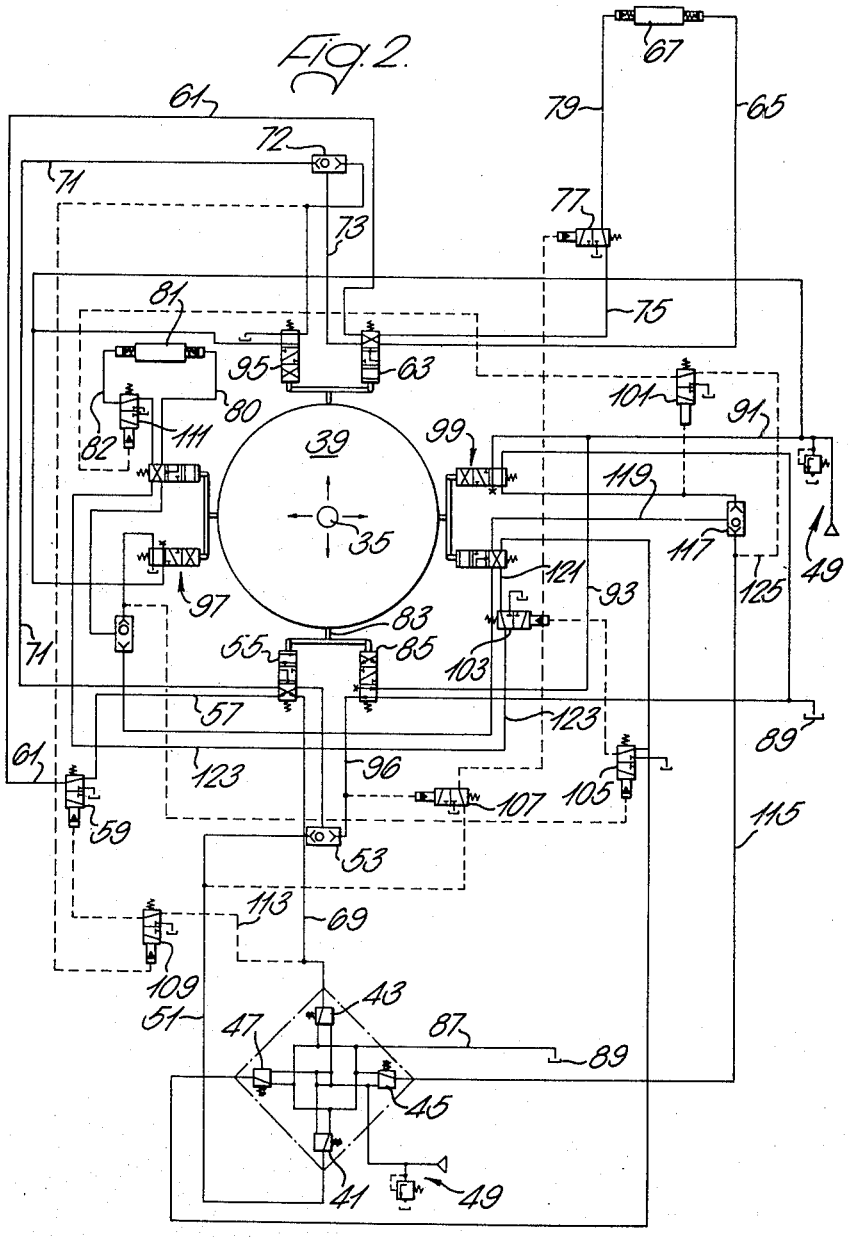

The invention is now described by way of example with reference to the accompanying drawings, in which:

FIGS. 1*a* and 1*b* are partly schematic perspective views showing respectively a boom mounted cutting head on a mining machine and provided with follower means responsive to movement of the boom, and a template and associated sensing device movable in dependence upon movement of the boom, and FIG. 2 is a partly schematic plan view showing the sensing device and hydraulic pilot control circuitry for the cutting boom.

Referring to FIGS. 1*a* and 1*b*, a mining machine is provided with a cutting head C supported on a boom B which is pivotally supported about a horizontal axis H on a pedestal P under the control of two lifting piston/-cylinder devices L. The pedestal P can swing about a vertical axis V under the control of two arcing piston/-cylinder devices A.

Vertical movement of the cutting head C is translated to a cam 1 whose movement is sensed by a follower 3 associated with a hydraulically operated vertical sender unit 5, which is connected by lines 7 to a piston/cylinder device 9. Likewise, horizontal movement (arcing) of the head C is translated to a cam 11 whose movement is sensed by a follower 13 associated with a hydraulically operated horizontal sender unit 15 which is connected by lines 17 to a piston/cylinder device 19.

A template 21 having a profile 23 corresponding to that of a tunnel to be cut by the cutting head C is mounted on a carrier 25 whose movement is controlled by the piston/cylinder devices 9 and 19. As can be seen from FIG. 1*b*, the carrier 25 is slidable horizontally on slides 27 under the control of the device 19, and slides 27 are supported on a platform 29 which itself is supported for horizontal sliding movement at right angles to that of carrier 25 on slides 31 supported on a table 33 under the control of device 9. It will thus be appreciated that every movement of the cutting head is translated accurately on a reduced scale to the template 21.

A cutting head position sensing device 35 is associated with template 23, the association being such that when template 21 moves to a position corresponding to a point on the periphery of the tunnel profile, the sensing device 35 will engage the profile 23. The sensing device 35 is supported on a stub shaft 37 projecting from an actuator plate 39 (see FIG. 2) which is mounted for universal rocking movement about any horizontal axis.

Normally, the boom B and hence the cutting head C is manually controlled by a "joystick" unit forming part of a standard hydraulic control device. One such device is known as a Pilot Valve type TH8 (RE 64110) marketed under the R.T.M. "HYDRONORMA" by G. L. Rexroth Ltd. The control lever of the joystick unit is supported on a ball located in a socket and has a cam plate secured to it for rocking movement with the joystick or control lever.

Associated with the control lever are four valves 41, 43, 45 and 47, each having an associated plunger which is actuated by the cam plate on the joystick. For example, when the joystick is moved forwardly to a "lift" position to raise the cutting head C, so the plunger of valve 43 will be actuated. Valve 41 is actuated when the joystick is moved to its "lower" position, and valves 47 and 45 are actuated when the joystick is moved to "left" and "right" arcing positions.

As can be seen from FIG. 2, when valve 41 is actuated, it will move to a position allowing flow of hydraulic fluid from source of pressure 49 into line 51, through a shuttle valve 53 and a vertical template control valve 55 (to be described later) into a line 57, then through a diverter valve 59 into a line 61. This line leads to a further vertical template control valve 63 (to be described later) and then to a line 65 which leads to a pilot operated lift control valve 67, which is a pilot operated main control valve for causing actuation of lifting cylinders L for lowering the cutting head C.

Similarly, when valve 43 is actuated (when the joystick is moved to its "raise" position) it will move to a position allowing flow from pressure source 49 into a line 69, through vertical template control valve 55 into a line 71, through shuttle valve 72 into a line 73, through vertical template control valve 63 into a line 75, through a further diverter valve 77, then into a line 79 leading to the opposite side of lift control valve 67, which will then be moved to a "raise" position, causing actuation of the lifting cylinders L to raise the cutting head C.

In a similar manner, when valve 45 is actuated, pressure will be applied to line 80 leading to the R.H.S. of arcing control valve 81, which is a pilot operated main control valve for causing actuation of arcing piston to move cutting head C to the right, cylinder devices A, and when valve 47 is actuated, pressure will be applied to the line 82 leading to the L.H.S. of control valve 81, to move the cutting head C to the left.

Of course, when the cuttng head C is moved in any direction, so this movement will be translated to the template 21. Supposing the operator has lowered the cutting head to cut away material at the foot of the tunnel, when sufficient material has been cut away and the correct tunnel profile at that location has been reached, so the appropriate part of the template profile 23 will move into engagement with the sensing device 35. As soon as the operator tries to move the cutting head vertically downwardly beyond the required tunnel profile, so the template profile 23 will cause the sensing device 35 to swing out of its vertical position of rest, thus causing the actuator plate 39 to rock and move into engagement with a sensor 83. Sensor 83 is connected by a yoke both to the control valve 55 and to a further associated control valve 85, and as soon as it is engaged by the actuator plate 39, it will cause the spools of the two control valves 55 and 85 to move from their illustrated position to an intermediate position. In this position, as can be seen from FIG. 2, pressure in the line 51, instead of leading to line 57, is blanked off by the intermediate location of the spool, and the previous pressure in the line 57 which had caused main lift control valve 67 to move to its "lower" position is vented or dumped, through valve 55, line 69, valve 43, and a line 87 to dump 89. This means that although the joystick is still in a "lower" position, thus still supplying pressure to valve 55, the sensing device 35 will have over-riden the joystick, thereby preventing the pressure reaching lift/lower main control valve 67, and thus preventing the cutting head from cutting further into the foot of the tunnel and cutting outside the desired tunnel profile. Instead it will remain in its lowered position.

Having achieved his lowermost cutting position, the operator would then move his joystick to the left or the right, either maintaining manual rearward (lowering) movement (i.e. actuation of valve 41) [situation 1] or cancelling it [situation 2]. If the operator moves the joystick left, under situation 1, so the template will follow. This, however, will immediately cause the sensing device to be rocked again (because the vertical component of the tunnel profile decreases from bottom dead centre) and this will result in the actuator plate being rocked still further against the sensor 83, causing the spools of the two valves 55 and 85 to be moved past their intermediate position to a third position in which the original flow directions through the valve are reversed. This means that the pressure in the line 51, instead of passing to line 57 (as originally) or being blanked off (for intermediate valve position) is guided to line 71, and subsequently to line 79 thus reversing direction of pilot operated main lift control valve 67, with the result that the cutting head will automatically be raised, as called for by the desired tunnel profile, and the shape of the template profile 23. As the operator moves the joystick further to the left under situation 1, so this situation will continue, although of course, if the template moves away from the sensing device 35, so valve 55 will be caused to move back to its intermediate (or even initial) position.

If the operator moves the joystick in such a manner as to fit situation 2, i.e. no lowering, and full cut to the left, and also does not move it so as to raise the boom, then valve 41 will no longer be actuated, and hence there will be no pressure to control valve 55 to raise the boom when the sensing device 35 causes plate 39 to move the valves 55 and 85 to their third position. However, this problem is solved by the presence of the second control valve 85.

When the control valve 85 is in its third position, an alternative pressure supply leading to it through lines 91, 93 is diverted into a line 96, through shuttle valve 53 and valve 55 (in its third position), into line 71 and eventually to line 79, so as again to cause pilot operated lift control valve 67 to move to "lift" position to cause lifting of the boom and hence cutting head C. In this situation, residual pressure in line 65 is vented via valve 63, line 61, diverter valve 59, line 57, valve 55, line 69, valve 43 and line 87 to dump 89.

A similar profile control arrangement is provided whenever the joystick is moved to an "arcing" position or a "raise" position, thus actuating one or a pair of the other valves 43, 45, 47 and subsequently bringing into the control operation the control valve 63 and its associated second control valve 95, and/or one of the pairs of arcing control valves 97 or 99. However, when the cutting head C reaches any one of its four "45°" positions, exactly halfway between a full "arcing" position and full "lift" or "lower" position, and the boom reaches its desired profile position, the template profile control circuitry will cause the control valves 97 or 99 and either 55, 85 or 63, 95 associated with the respective profile quadrant, to move to their intermediate positions, thus venting both the lifting and arcing main control valves 67 and 81 and effectively stopping the cutting operation. In this situation, there is no alternative but for the operator to move the joystick away from one of the "45°" positions, and manually start up the cutting operation again.

When the template control valves are in their intermediate positions, both sides of both the pilot operated lift control valve 67 and the pilot operated arcing control valve 81 are vented, making it impossible to actuate either main control valve. In order to overcome this problem, eight diverter valves, namely the valves 77 and 59, and valves 101, 103, 105, 107, 109 and 111 are provided. These valves allow one side or other of the arcing or lifting sylinders to be pressurised. To achieve this and get away from any one of the four "dead" 45° positions of the cutting tool C and sensing device 35, the operator has to move the joystick completely out of the sector associated with the 45° position of the cutting head C. Assuming that the cutting head is at the "half-past-seven" position, as shown in FIG. 2, then both of the profile control valves 55 and 85 and the pair of valves 97 will be in their intermediate positions. The operator must accordingly move his joystick back past the neutral position either in a vertical or a horizontal plane so as to cause either lifting or arcing of the cutting tool to move the sensing device 35 away from the profile 23. Let us assume that the operator lifts the boom to solve the situation; in doing this he will have to actuate the control valve 43 thus putting pressure into the line 69. This pressure, when it reaches the template control valve 55 in its intermediate position, will be transferred both to the line 57 and the line 71. However, it will also pass from the line 69 into a line 113 leading to diverter valve 109, through the valve 109 to the diverter valve 59 so as to move that valve to its second position in which pressure in the line 57 is blanked off. At the same time this will cause pressure in the line 61 to be vented or dumped, thus effectively releasing any pressure in the line 65 because this communicates with line 61 through valve 63. This means that pressure in the line 71 will pass through the shuttle valve 72 into line 73, through valve 63 into line 75 and through the diverter valve 77 into line 79 causing the pilot operated lift control valve 67 to move to its lift position, thus allowing the cutting tool to move upwardly. As soon as this happens, the operator can operate his joystick so as to move the cutting tool in the sector he was previously cutting to somewhere between the 7.30 position and the 9 o'clock position. The hydraulic circuitry will then take over cutting head guidance as before.

Should the operator decide to get away from the "dead" 7.30 position by arcing the cutting tool instead of lifting it, he would move the joystick to the right thus actuating the valve 45 so as to put pressure into a line 115 leading to shuttle valve 117 and then via a line 119 through one of the template control valves 99 into a line 121, through the diverter valve 103 into a line 123 and through one of the template control valves 97 and into the line 80 to pressurise the right hand side of the arcing pilot cylinder 81. At the same time, pressure in the line 115 would also lead into a line 125 through the diverter valve 101 to move the diverter valve 111 to its second position in which pressure previously in the line 82 leading to the left hand side of the pilot operated arcing control valve 81 would be vented or dumped. This means that the cutting head can move to the right as called for by movement of the joystick. Thereafter, automatic profile guidance can continue as described previously.

I claim:

1. Apparatus for controlling the profile of an aperture cut by a cutting head capable of traversing movement in two directions at right angles to each other, comprising means to control the movement of the cutting head in said two directions, a template having an internal profile representing that of the aperture to be cut, a sensing device engageable with the profile of the template, following means responsive to movement of the cutting head to cause relative movement between the sensing device and template in a direction which is related to the direction of movement of the cutting head, said sensing device being engageable with the profile of the template when the cutting head has been traversed sufficiently in a particular direction so as to reach its desired profile extremity, and hydraulic sensing equipment which is actuated in response to said sensing device and template coming into engagement, said sensing equipment being effective to over-ride said means controlling the movement of the cutting head to ensure the head does not cut outside its desired profile.

2. Apparatus according to claim 1, in combination with a tunnel cutting machine, which is provided with hydraulic control means for moving a boom-mounted cutting head in vertical and horizontal planes, and with hydraulic sensors for sensing the horizontal and vertical movements of the cutting head, said sensors having means through suitable hydraulic circuitry for translating said movement to the template which is mounted on a table for movement related to that of the head.

3. A tunnel cutting machine according to claim 2 wherein the sensing device is supported on a stub shaft projecting from an actuator plate which is mounted for universal rocking movement, as a result of engagement between the template and sensing device, in two horizontal planes at right angles to each other, and associated with the two planes of movement of the cutting head, there being one pair of sensors responsive, respectively, one to rocking movement of the plate in one sense and the other in the opposite sense, in one plane, and a second pair of sensors responsive, respectively, one to rocking movement of the plate in one sense and the other in the opposite sense, in the second plane, the arrangement being such that said plate rocks when said template moves into engagement with the sensing device when an attempt is made to move the cutting head beyond the boundary of said profile.

4. A tunnel cutting machine according to claim 2 or 3 wherein said hydraulic circuitry comprises a pilot control system for the main lifting and arcing valve and cylinder devices for controlling the boom.

5. A tunnel cutting machine according to claim 2 or 3 wherein the hydraulic control means for the cutting head includes a joystick unit comprising an operating lever and four hydraulic control valves, one associated with a respective quadrant of the profile to be cut, and suitable hydraulic circuitry supplying or venting hydraulic pressure to respective sides or arcing and lifting pilot operated main control valves which operate the respective lifting and arcing piston/cylinder devices of the boom, each of the sensors being associated with a hydraulic control valve means for over-riding the hydraulic control means, either to prevent lifting/lowering or arcing of the boom, or to reverse such movement, dependent on the position of the template relative to the sensing device.

6. A tunnel cutting machine according to claim 5 wherein the hydraulic control valve means comprise two control valves, one operative when there is pressure in the circuitry as a result of the joystick operating lever being in an operative position, and the other which is supplied from a second pressure source when the joystick operation lever is in an inoperative position in which there is no such pressure.

7. A tunnel cutting machine according to claim 6 wherein diverter valves are provided in the hydraulic circuitry so that when the joystick operating lever is operated to move the cutting head out of a quadrant associated with a "dead spot" which is reached when the cutting head is at any 45° position to the horizontal and vertical axes of the tunnel, the pressure leading to both sides of both the arcing and lifting main control valves will be diverted to one side of the respective control valve and vented or dumped.

8. A tunnel cutting machine according to claim 5 wherein diverter valves are provided in the hydraulic circuitry so that when the joystick operating lever is operated to move the cutting head out of a quadrant associated with a "dead spot" which is reached when the cutting head is at any 45° position to the horizontal and vertical axes of the tunnel, the pressure leading to both sides of both the arcing and lifting main control valves will be diverted to one side of the respective control valve and vented or dumped.

9. A tunnel cutting machine according to claim 6 wherein said hydraulic circuitry comprises a pilot control system for the main lifting and arcing valve and cylinder devices for controlling the boom.

* * * * *